US007015440B2

(12) United States Patent
Ryu

(10) Patent No.: US 7,015,440 B2
(45) Date of Patent: Mar. 21, 2006

(54) MICROWAVE OVEN AND METHOD OF CONTROLLING THE SAME

(75) Inventor: Han-Gyu Ryu, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 67 days.

(21) Appl. No.: 10/414,046

(22) Filed: Apr. 16, 2003

(65) Prior Publication Data

US 2004/0104220 A1 Jun. 3, 2004

(30) Foreign Application Priority Data

Nov. 29, 2002 (KR) ..... 10-2002-0075155

(51) Int. Cl.
*H05B 6/80* (2006.01)
*H05B 6/68* (2006.01)

(52) U.S. Cl. ..... 219/685; 219/702; 219/716; 219/756; 219/762; 219/404; 219/411

(58) Field of Classification Search ..... 219/685, 219/681, 702, 715, 716, 723, 756, 762, 404, 219/411
See application file for complete search history.

(56) References Cited

U.S. PATENT DOCUMENTS

| | | | | |
|---|---|---|---|---|
| 4,596,914 A * | 6/1986 | Morino | 219/681 |
| 4,629,850 A * | 12/1986 | Tanabe | 219/685 |
| 5,534,681 A * | 7/1996 | Hwang | 219/685 |
| 6,091,057 A * | 7/2000 | Asami et al. | 219/404 |
| 6,686,568 B1 * | 2/2004 | Hwang | 219/404 |

FOREIGN PATENT DOCUMENTS

KR 1996-9636 7/1996

* cited by examiner

*Primary Examiner*—Philip H. Leung
(74) *Attorney, Agent, or Firm*—Staas & Halsey LLP

(57) ABSTRACT

A microwave oven and a method of controlling the same, in which a cooking unit disposed in a cooking cavity is moved from an initial position to a cooking position. In the microwave oven, a magnetron is operated after heaters are moved to respective cooking positions where a rotating unit to move the heaters and the magnetron are operated. Accordingly, microwaves are radiated into the cooking cavity while the heaters are not being moved by the rotating unit, so a generation of heat and sparks resulting from a concentration of the microwaves into spaces between a moving unit including the rotating unit and the cooking unit and between the moving unit and a wall of the cooking cavity is preventable.

17 Claims, 3 Drawing Sheets

MICROWAVE OVEN AND METHOD OF CONTROLLING THE SAME

CROSS-REFERENCE TO RELATED APPLICATION

This application claims the benefit of Korean Patent Application No. 2002-75155, filed Nov. 29, 2002, in the Korean Intellectual Property Office, the disclosure of which is incorporated herein by reference.

BACKGROUND OF THE INVENTION

1. Field of the Invention

The present invention relates, in general, to a microwave oven and a method of controlling the same and, more particularly, to a microwave oven and a method of controlling the same, which prevents a generation of sparks resulting from a concentration of microwaves in a cooking cavity by a high frequency oscillation.

2. Description of the Related Art

Generally, a microwave oven is an apparatus to cook food using microwaves provided to a cooking cavity from a microwave oven.

Microwave ovens have been provided with heaters as a heating source in the cooking cavity, as well as a magnetron to irradiate the microwaves, and perform grill cooking by the heaters and combination cooking by the heaters and the magnetron.

In some models of microwave ovens, the heaters are rotatably disposed. Motors are disposed outside the cooking cavity such that rotating shafts of the motors penetrate a back wall of the cooking cavity, and are assembled to rotating members to which the heaters are attached.

Accordingly, when the grill cooking or the combination cooking is performed, the heaters are operated after the heaters reach respective predetermined heating positions by being rotated by the motors in some direction and when the grill cooking or the combination cooking is terminated, the heaters return to respective initial positions thereof by being rotated in a reverse direction.

However, when the combination cooking is performed by the conventional microwave oven, an operation of the magnetron and the rotation of the heaters are simultaneously performed. Accordingly, when the heaters are, respectively, rotated by the motors to reach the predetermined heating positions while the microwaves generated from the magnetron are radiated into the cooking cavity, the microwaves are concentrated into a space between the heaters and the rotating members or between the rotating shafts of the motors and the back wall of the cooking cavity, so sparks may occur in areas of a microwave concentration.

SUMMARY OF THE INVENTION

Accordingly, it is an aspect of the present invention to provide a microwave oven and a method of controlling the same, in which a magnetron is not operated while a moving unit to move a cooking unit disposed in a cooking cavity from an initial position to a cooking position is operated, thereby preventing a generation of heat and sparks resulting from a concentration of microwaves into spaces between the moving unit and the cooking unit and between the moving unit and a wall of the cooking cavity.

Additional aspects and/or advantages of the invention will be set forth in part in the description which follows and, in part, will be obvious from the description, or may be learned by practice of the invention.

The above and/or other aspects are achieved by providing a microwave oven including a magnetron that oscillates at a high frequency, a switching unit that switches an electrical connection between a power supply and the magnetron, a moving unit that moves a cooking unit disposed in a cooking cavity from an initial position to a cooking position, and a control unit that controls the switching unit so that the magnetron is operated after the cooking unit is moved to the cooking position by the moving unit, where the magnetron and the moving unit are operated.

The above and/or other aspects are achieved by providing a method of controlling a microwave oven including operating a magnetron after moving a cooking unit to a cooking position by operating a moving unit, where the moving unit moves the cooking unit disposed in a cooking cavity from an initial position to the cooking position and the magnetron is operated.

BRIEF DESCRIPTION OF THE DRAWINGS

These and/or other aspects and advantages of the invention will become apparent and more readily appreciated from the following description of the preferred embodiment, taken in conjunction with the accompanying drawings of which.

DETAILED DESCRIPTION OF THE PREFERRED EMBODIMENT

Figure 1:
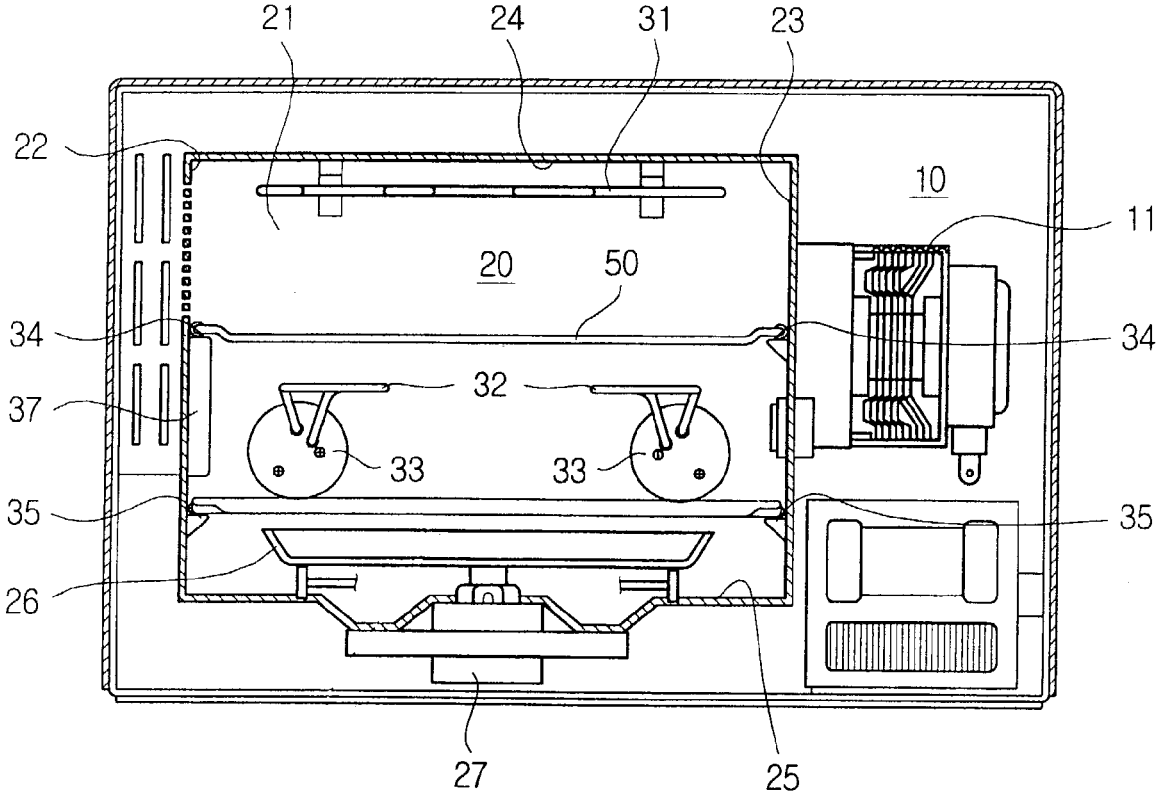
FIG. 1 is a schematic front sectional view of a microwave oven in accordance with an embodiment of the present invention.

Reference will now be made in detail to the present preferred embodiments of the present invention, examples of which are illustrated in the accompanying drawings, wherein like reference numerals refer to like elements throughout.

The present invention is directed to a microwave oven, in which a connecting portion between a cooking unit disposed in a cooking cavity, such as rotatably movable heaters, an ascendable turntable and an ascendable rack, and a moving unit to move the cooking unit from an initial position to a cooking position are exposed to microwaves in the cooking cavity.

Hereinafter, the embodiment according to the present invention is described in detail with reference to the accompanying drawings.

FIG. 1 is a schematic front sectional view of a microwave oven in accordance with the embodiment of the present invention.

As shown in FIG. 1, the microwave oven includes a machine room 10 having electrical parts, such as a magnetron 11, and generates microwaves, and a cooking cavity 20 that is separated from the machine room 10 and receives the microwaves generated from the magnetron 11 thereinto. The cooking cavity 20 has a back wall 21, left and right side walls 22 and 23, a top 24, and a bottom 25, and a front opening. A door (not shown) is disposed in front of the front opening of the cooking cavity 20, and is used to selectively open and close the cooking cavity 20. A rotatable turntable 26 and a motor 27 are disposed at the bottom 25 of the cooking cavity 20 such that food is placed on the rotatable turntable 26.

Further, an upper heater 31 that radiates high temperature heat toward an upper portion of the cooking cavity 20 is disposed in a vicinity of the top 24 of the cooking cavity 20. Two lower heaters 32 that radiate a high temperature heat toward upper and lower portions of the cooking cavity 20 are disposed between the upper heater 31 and the rotatable turntable 26. That is, the upper heater 31 is positioned in an upper portion of the cooking cavity 20, and the two lower heaters 32 are positioned between the upper heater 31 and the rotatable turntable 26. Accordingly, food placed on a rack 50 disposed between the upper heater 31 and the two lower heaters 32 receives heat at upper and lower surfaces of the food, and the food placed on the rotatable turntable 26 receives heat at an upper surface of the food.

Each one of the two lower heaters 32 is fixedly fitted into a plurality of holes formed in a respective rotating members 33 rotatably and movably disposed on the back wall 21 of the cooking cavity 20. The two lower heaters 32 are, respectively, rotatably moved by the rotating members 33 and motors (not shown) disposed outside the cooking cavity 20 from respective initial positions thereof to respective cooking positions thereof or from the respective cooking positions thereof to the respective initial positions thereof. Accordingly, the two lower heaters 32 are rotatably movable to the respective initial positions where the two lower heaters 32 are adjacent to the left and right side walls 22 and 23, respectively, or to the respective cooking positions where the two lower heaters 32 are horizontally disposed. Reference numerals 34 and 35 designate an upper support member and a lower support member, respectively.

Figure 2:
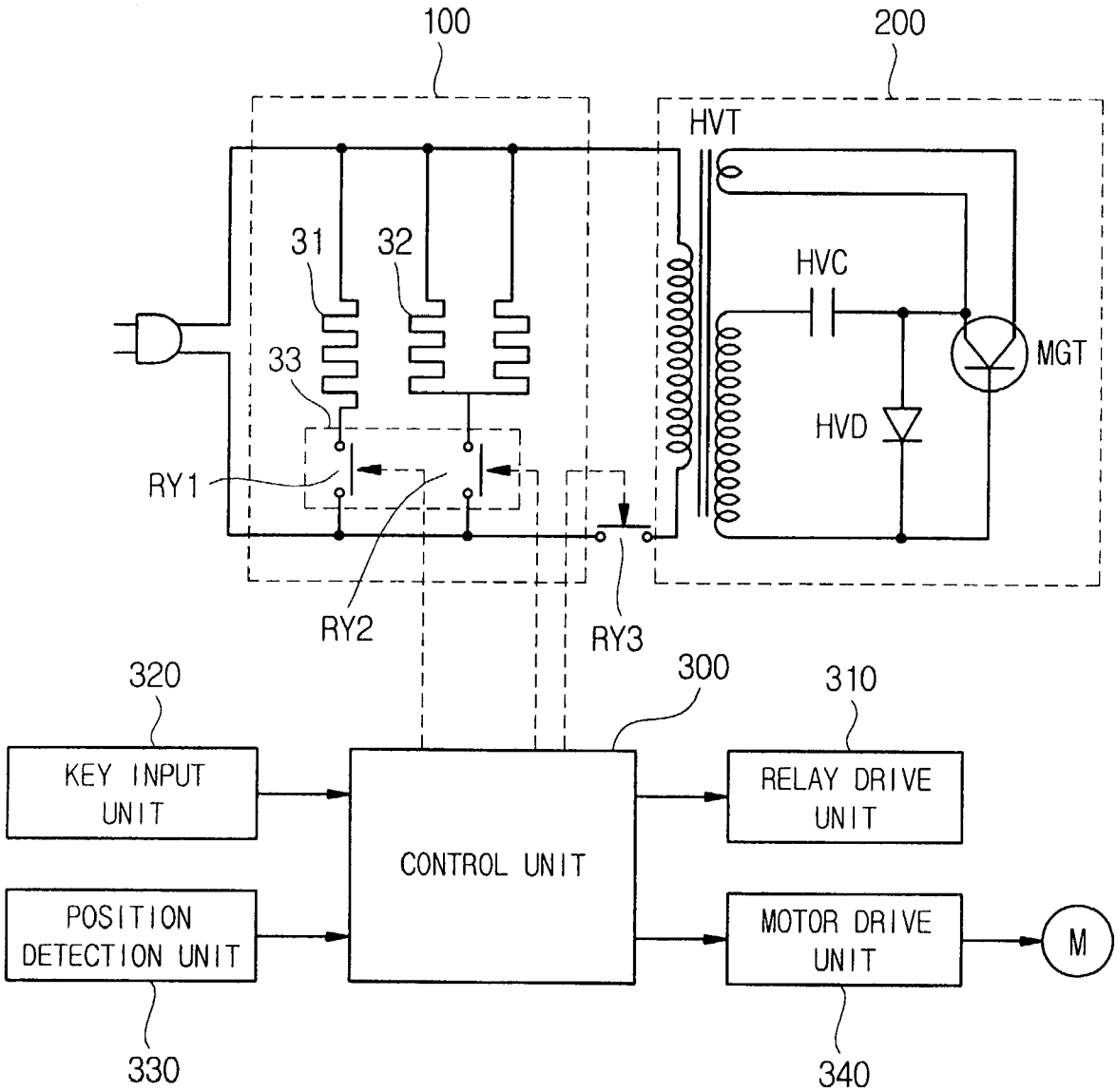
FIG. 2 is a control block diagram illustrating a cooking operation of the microwave oven shown in FIG. 1.

FIG. 2 is a control block diagram illustrating a cooking operation of the microwave oven shown in FIG. 1.

As shown in FIG. 2, the microwave oven includes a heater drive circuit 100 to operate the upper and lower heaters 31 and 32. The heater drive circuit 100 includes the upper and lower heaters 31 and 32 connected in parallel to an input alternating current (AC) power supply. The heater drive circuit 100 further includes switching units 33 between the input AC power supply and the upper and lower heaters 31 and 32. The switching units 33 selectively open and close electrical passages between the upper heater 31 and the input AC power supply and between the lower heaters 32 connected in parallel to each other and the input AC power supply, so power is supplied to or is cut off from the upper and lower heaters 31 and 32. The switching units 33 include a first relay switch RY1 and a second relay switch RY2, as in the example shown in FIG. 2, which are selectively turned on or turned off according to the power being supplied to or cut off from the upper and lower heaters 31 and 32. The first relay switch RY1 is turned off in response to a first electrical signal generated by the relay drive unit 310, under the control of the control unit 300 in a normal state and closes the electrical passage between the upper heater 31 and the input AC power supply, while the first relay switch RY1 is turned on in response to a second electrical signal generated by the relay drive unit 310, under the control of the control unit 300 and opens the electrical passage between the upper heater 31 and the input AC power supply. The second relay switch RY2 is turned off in response to a third electrical signal generated by the relay drive unit 310, under the control of the control unit 300 in a normal state and closes the electrical passage between the lower heaters 32 and the input AC power supply, while the second relay switch RY2 is turned on in response to a fourth electrical signal generated by the relay drive unit 310, under the control of the control unit 300 and opens the electrical passage between the lower heaters 32 and the input AC power supply.

Further, the microwave oven includes a high voltage unit control circuit 200 to operate the magnetron 11. The high voltage unit control circuit 200 includes a magnetron 11 that oscillates at a high frequency, a high voltage transformer HVT that boosts the voltage of the input AC power supply and outputs the boosted voltage to the magnetron 11, and a high voltage condenser HVC and a high voltage diode HVD that convert the boosted voltage outputted from the high voltage transformer HVT into a direct current of a high voltage. A third relay switch RY3 is connected between one terminal of a primary coil of the high voltage transformer HVT and one terminal of the input AC power supply to operate the magnetron 11. The high voltage unit control circuit 200 and the heater drive circuit 100 are connected in series to each other.

Further, the microwave oven includes a control unit 300 that controls an overall operation of the microwave oven, and a relay drive unit 310 that turns on or turns off the first, second and third relay switches RY1, RY2 and RY3. In this case, the control unit 300 operates the relay drive unit 310 by generating control signals corresponding to input signals of an key input unit 320, which is provided to a control panel of the microwave oven and provided with a combination cooking key, grill cooking key and a plurality of cooking keys to operate the magnetron 11.

Further, the microwave oven includes a motor drive unit 340 that operates the motors M to rotate the rotating members 33 to which the lower heaters 32 are fixedly attached, thereby rotatably moving the lower heaters 32, and a position detection unit 330 that detects the positions of the lower heaters 32 rotatably moved by an operation of the motors M.

Figure 3:
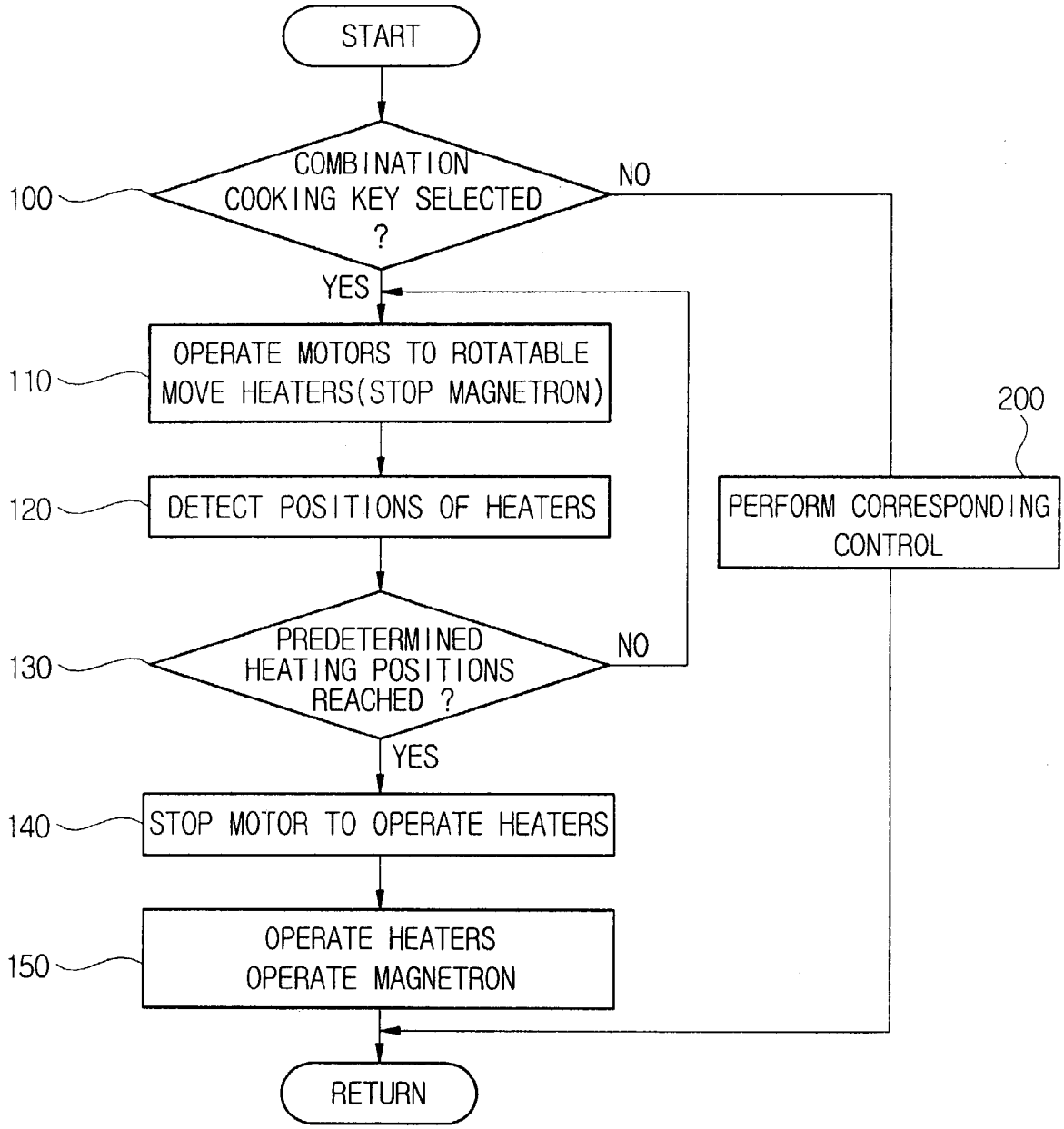
FIG. 3 is a flowchart illustrating a method of controlling the microwave oven of the embodiment of the present invention.

FIG. 3 is a flowchart illustrating a method of controlling the microwave oven of an embodiment of the present invention.

Referring to FIG. 3, the control unit 300 determines whether the combination cooking key is selected by a user at operation 100. If the combination cooking key is not selected, the control unit 300 performs a control corresponding to a selected key at operation 200.

If the combination cooking key is selected, the control unit 300 controls the motor drive unit 340 to operate the motors M so that the lower heaters 32 are rotatably moved to respective predetermined heating positions at operation 110. Accordingly, the rotating members 33 connected to the rotating shafts of the motors M are rotated, and the lower heaters 32 fixedly connected to the rotating members 33 are rotated along with the motors M. At this time, the control unit 300 controls the relay drive unit 310 to turn off the third relay RY3 so that the magnetron 11 is not operated during the rotation of the lower heaters 32.

Thereafter, the control unit 300 controls the position detection unit 330 to detect the positions of the lower heaters 32 to determine whether the lower heaters 32 reach the respective predetermined heating positions at operation 120.

Thereafter, the control unit 300 determines whether the detected positions and the respective predetermined heating positions are the same by comparing the detected positions with the respective predetermined heating positions at operation 130.

If the lower heaters 32 reach the predetermined heating positions, the control unit 300 controls the motor drive unit 340 to stop the operation of the motors M at operation 140.

After the motor drive unit 340 stops the motor M, the control unit 300 controls the relay drive unit 310 to turn on the third relay switch RY3, and allows the magnetron to operate at operation 150. At this time, the control unit 300 allows the first and second relay switches RY1 and RY2 to be turned on, so the control unit 300 allows the upper and lower heaters 31 and 32 to operate along with the magnetron 11.

As is apparent from the above description, the present invention provides a microwave oven and method of controlling the same, in which a magnetron is operated after a cooking unit is moved to a cooking position, where the magnetron and a moving unit to move the cooking unit from an initial position to the cooking position is operated, thereby preventing a generation of heat and sparks resulting from a concentration of microwaves into spaces between the moving unit and the cooking unit and between the moving unit and a wall of the cooking cavity.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A microwave oven with a cooking cavity therein and a magnetron therein to oscillate at a high frequency and a cooking unit disposed in the cooking cavity to heat food, comprising:

a power control unit to control an operation of the magnetron:

a moving unit to move the cooking unit into a cooking position; and a control unit to control both the power control unit and the moving unit such that the magnetron heats the food before and only after the cooking unit is moved to the cooking position, and operation of the magnetron is prohibited when the moving unit is moving the cooking unit, the magnetron and the cooking unit being disposed to heat the food together after the movement of the cooking unit, wherein the cooking unit comprises:

plural heaters; and the control unit comprises:

a first switch and a second switch, which are selectively turned on or turned off to supply the power to or cut the power off from a selected one or ones of the plural heaters, and wherein the control unit further comprises:

a relay drive unit, wherein the first switch is turned off in response to a first electrical signal generated by the relay drive unit and closes an electrical passage between one of the plural heaters and a power supply, and the first switch is turned on in response to a second electrical signal generated by the relay drive unit and opens the electrical passage between the one heater and the power supply, and the second switch is turned off in response to a third electrical signal generated by the relay drive unit and closes an electrical passage between a remaining one or ones of the plural heaters and the power supply, and the second switch is turned on in response to a fourth electrical signal generated by the relay drive unit and opens the electrical passage between the remaining one or ones of the plural heaters and the power supply.

2. The microwave oven as set forth in claim 1, wherein the moving unit comprises:

a connecting portion exposed in the cooking cavity and the cooking unit is attached thereby.

3. The microwave oven as set forth in claim 1, the moving unit comprises:

a rotating unit that rotates the heaters.

4. The microwave oven as set forth in claim 3, wherein:

the cooking cavity comprises:

a back wall thereof; and the rotating unit comprises:

motors having respective rotating shafts that are disposed in the back wall of the cooking cavity, and respective rotating members that are connected to the respective rotating shafts of the motors penetrating the back wall of the cooking cavity, each of the respective rotating members provided with plural holes into which a corresponding one or ones of the heaters is fixedly fitted.

5. The microwave oven as set forth in claim 4, further comprising:

connecting portions extending from the respective rotating shafts of the motors to the back wall of the cooking cavity and being exposed in the cooking cavity.

6. The microwave oven as set forth in claim 1, further comprising:

a position detection unit that detects a position of the cooking unit, wherein the control unit controls the power control unit so that the magnetron is operated based on the position of the cooking unit detected by the position detection unit.

7. The microwave oven as set forth in claim 1, wherein:

the cooking cavity comprises:

a back wall thereof;

the cooking unit comprises:

plural heaters to heat food contained in the cooking cavity; and the moving unit comprises:

one or more motors having respective moving shafts that are disposed in the back wall of the cooking cavity, and respective moving members connected to the respective moving shafts of the one or more motors penetrating the back wall of the cooking cavity, each of the respective moving members being connected to a corresponding one or ones of the plural heaters.

8. The microwave oven as set forth in claim 7, wherein each of the moving members has one or more holes into which the corresponding one or ones of the heaters is fixedly fitted.

9. The microwave oven as set forth in claim 7, further comprising:

connecting portions extending from the respective moving shafts of the one or more motors to the back wall of the cooking cavity and being exposed in the cooking cavity.

10. The microwave oven as set forth in claim 1, wherein:

the cooking cavity comprises:

a back wall thereof; and the rotating unit comprises:

one or more motors having respective rotating shafts that are disposed in the back wall of the cooking cavity, and respective rotating members connected to the respective rotating shafts of the one or more motors penetrating the back wall of the cooking cavity, each of the respective rotating members being connected to a corresponding one or ones of the plural heaters.

11. The microwave oven as set forth in claim 10, wherein each of the rotating members has one or more holes into which the corresponding one or ones of the plural heaters is fixedly fitted.

12. The microwave oven as set forth in claim 10, further comprising:

connecting portions extending from the respective rotating shafts of the one or more motors to the back wall of the cooking cavity and being exposed in the cooking cavity.

13. A method of controlling a microwave oven including a cooking cavity therein having a movable cooking unit to heat food to be acted upon by a moving unit provided to move the cooking unit from an initial position in the cooking cavity to a cooking position in the cooking cavity and a magnetron, comprising:

operating the magnetron to heat the food before and after a movement of the cooking unit to the cooking position by an operation of a moving unit, and prohibiting the magnetron from operating when the moving unit is moving the cooking unit, the cooking unit and the magnetron being disposed to heat the food together after the movement, wherein the operating of the magnetron comprises:

determining whether a combination cooking operation to simultaneously operate the moving unit and the magnetron is selected;

moving the cooking unit from the initial position to the cooking position if the combination cooking operation is selected;

detecting a position of the cooking unit;

determining whether the cooking unit reaches a predetermined cooking position based on the detected position of the cooking unit;

stopping the moving unit if the cooking unit reaches the predetermined cooking position; and operating the magnetron with the moving unit stopped.

14. A microwave oven with a cooking cavity therein and a magnetron therein to oscillate at a high frequency and a cooking unit disposed in the cooking cavity to heat food, comprising:

a power control unit to control an operation of the magnetron;

a moving unit to move the cooking unit into a cooking position; and a control unit to control both the power control unit and the moving unit such that the magnetron heats the food before and only after the cooking unit is moved to the cooking position, and operation of the magnetron is prohibited when the moving unit is moving the cooking unit, the magnetron and the cooking unit being disposed to heat the food together after the movement of the cooking unit, wherein the cooking unit comprises:

plural heaters to heat food contained in the cooking cavity; and the moving unit comprises:

a rotating unit to rotate the plural heaters, and wherein the control unit comprises:

a relay drive unit;

a first switch turned off in response to a first electrical signal from the relay drive unit and closes an electrical passage between one of the plural heaters and a power supply, and the first switch is turned on in response to a second electrical signal from the relay drive unit and opens the electrical passage between the one heater and the power supply; and a second switch turned off in response to a third electrical signal from the relay drive unit and closes an electrical passage between a remaining one or ones of the plural heaters and the power supply, and the second switch is turned on in response to a fourth electrical signal from the relay drive unit and opens the electrical passage between the remaining one or ones of the plural heaters and the power supply.

15. The microwave oven as set forth in claim 14, wherein the moving unit comprises:

a connecting portion exposed in the cooking cavity and the cooking unit is attached thereby.

16. A method of controlling a microwave oven having a cooking cavity and a magnetron therein and a cooking unit disposed in the cooking cavity, comprising:

controlling power to the magnetron;

moving the cooking unit into a cooking position; and controlling the moving and the controlling of the power such that the magnetron heats the food before and only after the cooking unit is moved to the cooking position, and to prohibit the magnetron from operating when the moving unit is moving the cooking unit, the magnetron and the cooking unit being disposed to heat the food together after the movement of the cooking unit;

wherein the controlling of the moving comprises determining whether a combination cooking operation to simultaneously move the cooking unit and operate the magnetron is selected; and the moving of the cooking unit comprises:

moving the cooking unit from an initial position to the cooking position if the combination cooking operation is selected;

detecting a position of the cooking unit;

determining whether the cooking unit reaches a predetermined cooking position based on the detected position of the cooking unit;

stopping the moving unit if the cooking unit reaches the predetermined cooking position; and operating the magnetron with the moving unit stopped.

17. A method of controlling a microwave oven having a cooking cavity therein and a magnetron to heat food, comprising:

operating the magnetron to heat the food before moving a cooking unit to a second position by operation of a moving unit and thereafter, and to prohibit the magnetron from operating when the moving unit is moving the cooking unit, the cooking unit and the magnetron being disposed to heat the food together after the movement of the cooking unit, the moving unit being provided to move the cooking unit disposed in the cooking cavity from a first position to the second position;

wherein the operating of the magnetron comprises:

determining whether a combination cooking operation to simultaneously operate the moving unit and the magnetron is selected;

moving the cooking unit from the first position to the second position if the combination cooking operation is selected;

detecting a position of the cooking unit;

determining whether the cooking unit reaches a predetermined cooking position based on the detected position of the cooking unit;

stopping the moving unit if the cooking unit reaches the predetermined cooking position; and operating the magnetron with the moving unit stopped.

* * * * *